US005951453A

United States Patent [19]

Yeager

[11] Patent Number: 5,951,453

[45] **Date of Patent: *Sep. 14, 1999**

[54] RECLOSEABLE BAG ASSEMBLY AND METHOD OF MAKING SAME

[75] Inventor: James W. Yeager, Mobile, Ala.

[73] Assignee: Innoflex Incorporated, Mobile, Ala.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/749,789

[22] Filed: Nov. 15, 1996

[51] Int. Cl.[6] ..... B31B 1/84

[52] U.S. Cl. ..... 493/213; 493/214; 383/63; 383/97; 383/263; 53/139.2

[58] Field of Search ..... 383/61, 63, 65, 383/95, 97, 203; 493/213, 214; 53/451, 551, 133.4, 133.6, 139.2, 138.1

[56] References Cited

U.S. PATENT DOCUMENTS

| | | | |
|---|---|---|---|
| Re. 29,043 | 11/1976 | Naito . | |
| 2,978,769 | 4/1961 | Harrah . | |
| 3,172,443 | 3/1965 | Ausnit . | |
| 3,181,583 | 5/1965 | Lingenfelter . | |
| 3,266,965 | 8/1966 | Spees . | |
| 3,338,285 | 8/1967 | Jaster . | |
| 3,405,861 | 10/1968 | Bush . | |
| 3,426,959 | 2/1969 | Lemelson . | |
| 3,440,696 | 4/1969 | Staller . | |
| 3,449,888 | 6/1969 | Gausman . | |
| 3,473,589 | 10/1969 | Gotz . | |
| 3,532,571 | 10/1970 | Ausnit . | |
| 3,543,343 | 12/1970 | Staller et al. . | |
| 3,570,375 | 3/1971 | Williams et al. . | |
| 3,608,439 | 9/1971 | Ausnit . | |
| 3,625,270 | 12/1971 | Skenzic | 383/61 |
| 3,685,562 | 8/1972 | Ausnit . | |
| 3,717,244 | 2/1973 | Smith . | |
| 3,789,888 | 2/1974 | James et al. . | |
| 3,827,472 | 8/1974 | Uramoto . | |
| 3,948,705 | 4/1976 | Ausnit . | |
| 4,020,884 | 5/1977 | Jadot . | |
| 4,046,408 | 9/1977 | Ausnit . | |
| 4,094,729 | 6/1978 | Boccia . | |
| 4,241,865 | 12/1980 | Ferrell . | |
| 4,246,288 | 1/1981 | Sanborn, Jr. | 383/63 |
| 4,285,105 | 8/1981 | Kirkpatrick . | |
| 4,332,344 | 6/1982 | Strodthoff . | |
| 4,335,817 | 6/1982 | Bahr . | |
| 4,341,575 | 7/1982 | Herz . | |

(List continued on next page.)

FOREIGN PATENT DOCUMENTS

| | | |
|---|---|---|
| 719570 | 10/1965 | Canada . |
| 0 485 741 A1 | 5/1990 | European Pat. Off. . |
| 0 528 721 A2 | 2/1993 | European Pat. Off. . |
| 1 031 136 | 6/1953 | France . |
| 1 079 480 | 11/1954 | France . |
| 1 423 849 | 3/1966 | France . |
| 54-39218 | 8/1977 | Japan . |
| 452 430 | 5/1968 | Switzerland . |
| 998967 | 7/1965 | United Kingdom . |

*Primary Examiner*—James F. Coan
*Assistant Examiner*—Gene L. Kim
*Attorney, Agent, or Firm*—Rockey, Milnamow & Katz, Ltd.

[57] ABSTRACT

A package in the form of a recloseable bag includes a bag body including front and back walls, and a profile strip fastener assembly sealingly mounted on the inside surface of the front wall. The profile strip fastener assembly includes a pair of releasably interlocking profile strips. One of the profile strips is connected to the inside of the front wall of the bag, while the other one of the profile strips includes a flange portion which extends from the profile strips to and adjacent end seal of the bag. A method of forming recloseable bags is disclosed, which method can be employed with a form, fill, and seal machine for effecting the efficient packaging of products in recloseable bags.

8 Claims, 3 Drawing Sheets

U.S. PATENT DOCUMENTS 4,354,541 10/1982 Tilman .
4,355,494 10/1982 Tilman .
4,372,793 2/1983 Herz .
4,401,213 8/1983 Lerner .
4,430,070 2/1984 Ausnit .
4,449,962 5/1984 Copia .
4,479,244 10/1984 Ausnit .
4,555,282 11/1985 Yano .
4,570,820 2/1986 Murphy .
4,582,549 4/1986 Ferrell .
4,601,694 7/1986 Ausnit .
4,617,683 10/1986 Christoff .
4,619,021 10/1986 Johnson .
4,655,862 4/1987 Christoff .
4,663,915 5/1987 Van Erden et al. .
4,666,536 5/1987 Van Erden et al. .
4,691,373 9/1987 Ausnit .
4,709,398 11/1987 Ausnit .
4,709,533 12/1987 Ausnit .
4,756,629 7/1988 Tilman et al. .
4,782,951 11/1988 Griesbach et al. .
4,790,126 12/1988 Boeckmann .
4,817,188 3/1989 Van Erden ..... 383/63
4,840,611 6/1989 Van Erden et al. .
4,848,928 7/1989 Ausnit .
4,892,414 1/1990 Ausnit .
4,894,975 1/1990 Ausnit .
4,896,775 1/1990 Boeckmann et al. .
4,902,140 2/1990 Branson .
4,909,017 3/1990 McMahon et al. .
4,925,316 5/1990 Van Erden et al. .
4,925,318 5/1990 Sorensen .
4,969,967 11/1990 Sorensen .
4,993,844 2/1991 Robinson et al. .
5,022,530 6/1991 Zieke .
5,024,537 6/1991 Tilman .
5,026,563 6/1991 Van Erden et al. ..... 383/61
5,036,643 8/1991 Bodolay .
5,050,736 9/1991 Griesbach et al. .
5,063,069 11/1991 Van Erden et al. .
5,096,516 3/1992 McDonald et al. .
5,116,140 5/1992 Hirashima .
5,157,811 10/1992 Bodolay .
5,167,608 12/1992 Steffens, Jr. et al. .
5,186,543 2/1993 Cochran .
5,188,461 2/1993 Sorensen .
5,461,845 10/1995 Yeager .
5,519,982 5/1996 Herber et al. ..... 53/133.4
5,525,363 6/1996 Herber et al. ..... 383/61
5,592,802 1/1997 Malin et al. ..... 53/139.2
5,601,368 2/1997 Bodolay et al. .
5,672,009 9/1997 Malin ..... 383/61
5,782,733 7/1998 Yeager ..... 493/213

RECLOSEABLE BAG ASSEMBLY AND METHOD OF MAKING SAME

TECHNICAL FIELD

The present invention relates generally to flexible bag-like packages, and more particularly to a flexible recloseable bag package including an improved profile strip fastener assembly mounted on a front wall of the body of the bag, wherein the fastener assembly includes a flange portion joined to an end seal of the bag. A method is disclosed for making recloseable bags which facilitates use of the present invention on conventional form, fill, and seal machinery.

BACKGROUND OF THE INVENTION

Recloseable packaging is particularly suited for packaging of food products when it is desired to repeatedly remove relatively small quantities of the food product. Such food products include cereals, rice, candies, and the like, and may also include meat food products, such as chicken, frankfurters, sliced meats, etc. While the use of recloseable, flexible bags having twist-tie wire fasteners or plastic clasps has long been known, recent advents in recloseable packaging have included configuring packages to have integral zipper-type fastener assemblies, including interlocking profile strips. In such arrangements, the package is typically opened by cutting or tearing a portion of the package to gain access to the fastener assembly, with opening and closing of the profile strips of the fastener assembly thereafter permitting the package to be selectively opened and closed.

While packages having integrated profile strips fastener assemblies are becoming common in the marketplace, heretofore, such arrangements have typically required specialized packaging machinery for forming and filling such packages. Notably, U.S. Pat. No. 5,461,845 discloses a recloseable package, and method of formation, which is specifically configured to facilitate use on conventional, so-called form, fill, and seal machinery. This type of machinery forms and fills packages with a food product (or other articles) by forming a package from a web of plastic film material or the like, and substantially simultaneously filling and sealing the package. The package disclosed in the above-referenced patent includes a profile strip fastener assembly which is configured such that a plurality of fastener assemblies can be provided on a substantially continuous web of package-forming material. The web of packaging material can be formed at, or supplied to, a conventional form, fill, and seal machine, with the machine operated in a generally conventional manner to package the product as desired. By the provision of the profile strip fastener assembly in the front wall portion of the package, convenient reclosability of the package is provided without resort to twist-tie fasteners, plastic clasps, or the like. The above-referenced patent is hereby incorporated by reference.

The present invention contemplates a recloseable package in the form of a bag which is configured for use with conventional form, fill, and seal machinery, with a method of making bags in accordance with the present invention also disclosed.

SUMMARY OF THE INVENTION

A package in the form of a recloseable bag embodying the principles of the present invention includes a profile strip fastener assembly which is joined to a front wall of a bag body in a manner which permits formation of the bag in web form prior to use with a conventional form, fill, and seal machine. If desired, a plurality of the fastener assemblies can be joined to an associated web of plastic film material and stored in rolled or fan-folded form prior to use with filling machinery, or can be assembled in conjunction with the filling operation. Notably, one of the profile strips of the fastener assembly includes a flange portion which extends longitudinally of the bag and is joined and sealed within one of the transverse end seals of the bag.

In accordance with the illustrated embodiment, the present recloseable bag includes a bag body formed from film material, with the bag body having a top end, a bottom end, a front wall, and a back wall. The front wall is joined to the back wall by upper and lower seals or seams respectively provided at the top and bottom ends of the bag body.

A recloseable fastener assembly joined to the front wall of the bag body comprises first and second interlocking profile strips respectively extending along the length of the fastener assembly. The profile strips are configured for releasable interlocking engagement with each other by the provision of at least one protuberance on one of the profile strips, and at least one groove defined by the other of the profile strips for respectively releasably receiving the protuberance.

Disposition of the profile strip assembly within the bag body is effected by joining a first one of the profile strips to the inside surface of the front wall of the bag body. Notably, the other one of said profile strips, i.e., the second profile strip, includes a flange portion extending from a body portion thereof into one of the upper and lower seals of the bag body. By this arrangement, the profile strips can be positioned on a surface of film material, from which the bag bodies are formed, by connecting the one of the profile strips to a surface of the film material. Attendant to supply of the film material (and fastener assemblies thereon) to a form, fill, and seal machine, the flange portion of the other one of the profile strips is effectively connected with the bag body by sealing of the flange portion into an adjacent one of the end seals of the bag. These end seals are formed transversely of the longitudinal axis of the film material attendant to the filling operation.

In order to facilitate access to the contents of the bag, an elongated, frangible access means can be provided in the front wall of the bag body substantially aligned with the fastener assembly. It is also within the purview of the present invention to provide a pair of end seals at respective opposite ends of the fastener assembly for joining respective ends of said profile strips to each other, and end ends of the fastener assembly to the front wall of the bag body.

A method of making recloseable bags in accordance with the present invention includes the steps of providing a substantially continuous sheet of film material, and providing a plurality of fastener assemblies each comprising first and second interlocking profile strips. The present method further includes connecting each of the fastener assemblies to a surface of the film material in spaced apart relationship to each other along a longitudinal axis of the film material. This is effected by connection of the first one of the profile strips of each of the fastener assemblies to the associated surface of the film material.

The present method further includes folding of the film material, and sealing of side edges thereof to each other to form a tube enclosing the fastener assemblies. As will be appreciated, such folding and sealing typically is effected attendant to supply of the film material and fastener assemblies to a form, fill, and seal machine.

Attendant to filling of the bags being formed, the tube of material is sealed transversely to the longitudinal axis thereof to form a series of recloseable bags joined in end-to-end relationship. In accordance with the present invention, the present method includes providing the second one of the profile strips of each fastener assembly with a flange portion, and sealing each flange portion to said tube of film material during the transverse sealing of the tube of film material.

In one illustrated embodiment of the present method, the flange portion of each fastener assembly is sealed at a respective one of the upper and lower seams of the bag being formed, such that the flange portion of the fastener assembly of each of the bags is joined to a like one of the end seals (i.e., each flange portion to its respective upper seam, or each flange portion to its respective lower seam). In an alternate embodiment, a common flange portion is provided between adjacent ones of a pair of the fastener assemblies. In this alternate embodiment, the fastener assemblies are connected to the film material in adjacent pairs, with a common one of the flange portions extending between the second ones of the profile strips of each adjacent pair for sealing transversely of said tube of material between the fastener assemblies of each adjacent pair. In this embodiment, while the bags are arranged in end-to-end relationship, upper ends (or lower ends) of adjacent bags are joined together, with the common flange portion of the fastener assemblies of the adjacent bags extending through the transverse seal therebetween, until the film material is cut to create individual, filled packages.

Other features and advantages of the present invention will become readily apparent from the following detailed description, the accompanying drawings, and the appended claims.

DETAILED DESCRIPTION

Figure 3:
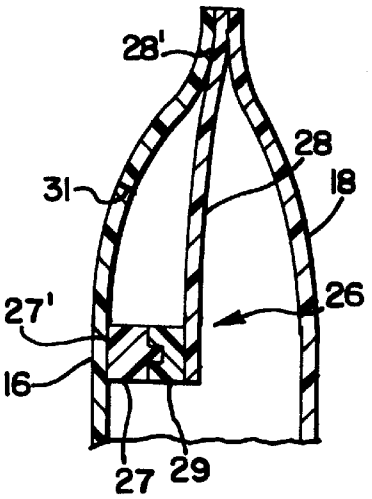
FIG. 3 is a cross-sectional view of the present recloseable bag taken generally along line 3—3 of FIG. 1.

While the present invention is susceptible of embodiment in various forms, there is shown in the drawings, and will hereinafter be described, a presently preferred embodiment, with the understanding that the present disclosure is to be considered an exemplification of the invention, and is not intended to limit the invention to the specific embodiment illustrated.

With reference now to the drawings, therein is illustrated a package in the form of a recloseable bag 10 embodying the principles of the present invention. It is contemplated that the bag 10 be formed from suitable plastic film material or the like, but it is within the purview of the present invention to form the bag from paper or paper-like materials. As will hereinafter be described, bag 10 is specifically configured in a manner which facilitates formation of the bag from a substantially continuous web of film material, to which fastener assemblies are applied for use in a so-called form, fill, and seal apparatus for packaging of food products, or non-food products. For example, the present package can be configured for packaging non-food products such as hardware articles or the like, wherein repeated opening and closing of the package is desired.

The recloseable bag 10 is formed from a generally rectangular sheet of film material, and includes a top end generally designated 12, a bottom end generally designated 14, and front and back walls 16, 18. The front and back walls are joined to each other by upper and lower seals or seams 20, 22, respectively provided at top and bottom ends 12 and 14 of the bag. Lateral edges of the rectangular sheet of film material from which the bag is formed are joined to each other along a back seal or seam 24 extending vertically along back wall 18. The seals 20, 22, and 24 can be formed adhesively, or by heat-sealing as is known in the art.

Recloseable bag 10 includes a profile strip fastener assembly 26 which is sealingly mounted on the inside surface of front wall 16. In order to permit use of the present bag with convention packaging equipment, the fastener assembly 26 has a length no more than one-half the width of the rectangular sheet of film material from which the bag body is formed. As will be further described, a substantially continuous sheet of film material can be provided with a plurality of fastener assemblies 26 mounted thereon at spaced locations. The fastener assemblies can be positioned on a web of film material prior to use for product packaging, or can be assembled together in an in-line process, just upstream of an associated packaging machine. The web of film material (with fastener assemblies mounted thereon) is supplied to a form, fill, and seal apparatus which operates to form a series of bags 10, in end-to-end relationship, by formation of the back seam (by folding of the film material into a tube) bottom seal 22, and top seal 20, as the product to be packaged is supplied to the individual bags being formed. After formation and filling, the individual bags are ordinarily separated from each other for packaging and shipment, as may be required.

Figure 2:
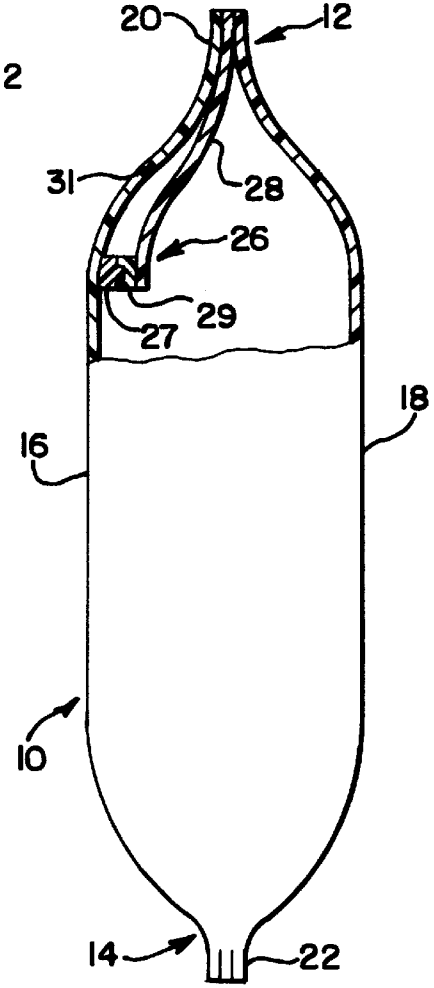
FIG. 2 is a side elevational view, partially cut-away, of the bag illustrated in FIG. 1.

With particular reference to FIGS. 2 and 3, the fastener assembly 26 includes a first elongated profile strip 27, and a second elongated profile strip 29 which are configured for releaseable interlocking engagement with each other. While the specific configuration of the profile strips can be varied while keeping with the principles disclosed herein, it is contemplated that one of the profile strips (first strip 27 in the illustrated embodiment) includes a body portion which defines at least one protuberance, while the other of the profile strips includes a body portion which defines at least one elongated groove configured for respective interlocking engagement with the protuberance of the other profile strip. As will be recognized by those familiar with the art, the number of grooves and protuberances, and the respective disposition on the first and second profile strip, can be varied while keeping with the principles disclosed herein.

The fastener assembly 26 is sealingly mounted on the inside surface of the front wall 16 of the body of the recloseable bag 10 parallel to the end seals thereof, and to this end, the first profile strip 27 is connected to the inside surface of the front wall of the bag body by a seal 27'. It is within the purview of the present invention that the seal 27' may be formed with the use of a suitable adhesive, or may be provided by heat-sealing or the like. The seal 27' is preferably continuous for strength and for sealing of the contents of the bags, but a discontinuous seal may be suitable for some applications.

As illustrated, the fastener assembly 26 is further connected within the bag body 12 by the provision of a flange portion 28 provided on the other one of the profile strips of the fastener assembly, namely second profile strip 29. During initial formation of the present recloseable bag, the profile strip assembly 26 is joined to the associated surface of film material by connection of the first one of the profile strips, profile strip 27, directly to the film material. The other one of the profile strips, profile strip 29, is joined to the profile strip 27, with the flange portion 28 thereof extending from the profile strips in the longitudinal direction of the bag. The flange portion 28 may be unitary with the body portion of the profile strip 29, i.e., formed from the same piece of material, or may be formed from different material than the body portion.

In accordance with the present invention, the flange portion 28 of the second profile strip 29 is joined to the bag body at one of the upper and lower end seals 20, 22, with the illustrated embodiment having flange portion 28 joined to the bag body at upper seal 22 by a suitable seal 28'. Like seal 27', seal 28' can be adhesively provided, or be provided in the form of heat-sealing or the like. As will be appreciated, it is contemplated that the seal 28' for the flange portion 28 will be formed at the time of formation of the respective end seal attendant to filling of the recloseable bag during use in a form, fill, and seal machine. Thus, highly efficient formation of each bag 10 can be effected in conjunction with a packaging operation.

As illustrated, the present recloseable bag 10 may optionally be provided with a frangible access opening, such as a perforated line 31 or an otherwise preferentially weakened region, provided in the front wall 16 in substantial alignment with profile strip fastener assembly 26. By fracture and opening of access opening 31, and subsequent separation of the profile strips of the fastener assembly, access to the recloseable package 10 is provided. Alternatively, the package can be opened by separation of the front wall from the flange portion at flange portion seal 28', in this manner providing the desired access to the profile strip fastener assembly for opening and closing the bag. As is known in the art, the flange portion 28 can be treated, such as by corona discharge, to configure seal 28' as a peelable seal to facilitate bag opening.

It is also optional to seal the opposite end portions of the profile strip fastener assembly, thus sealing the profile strips to each other, and the ends of the fastener assembly to the inside surface of the front wall 16 of the bag.

Figure 1:
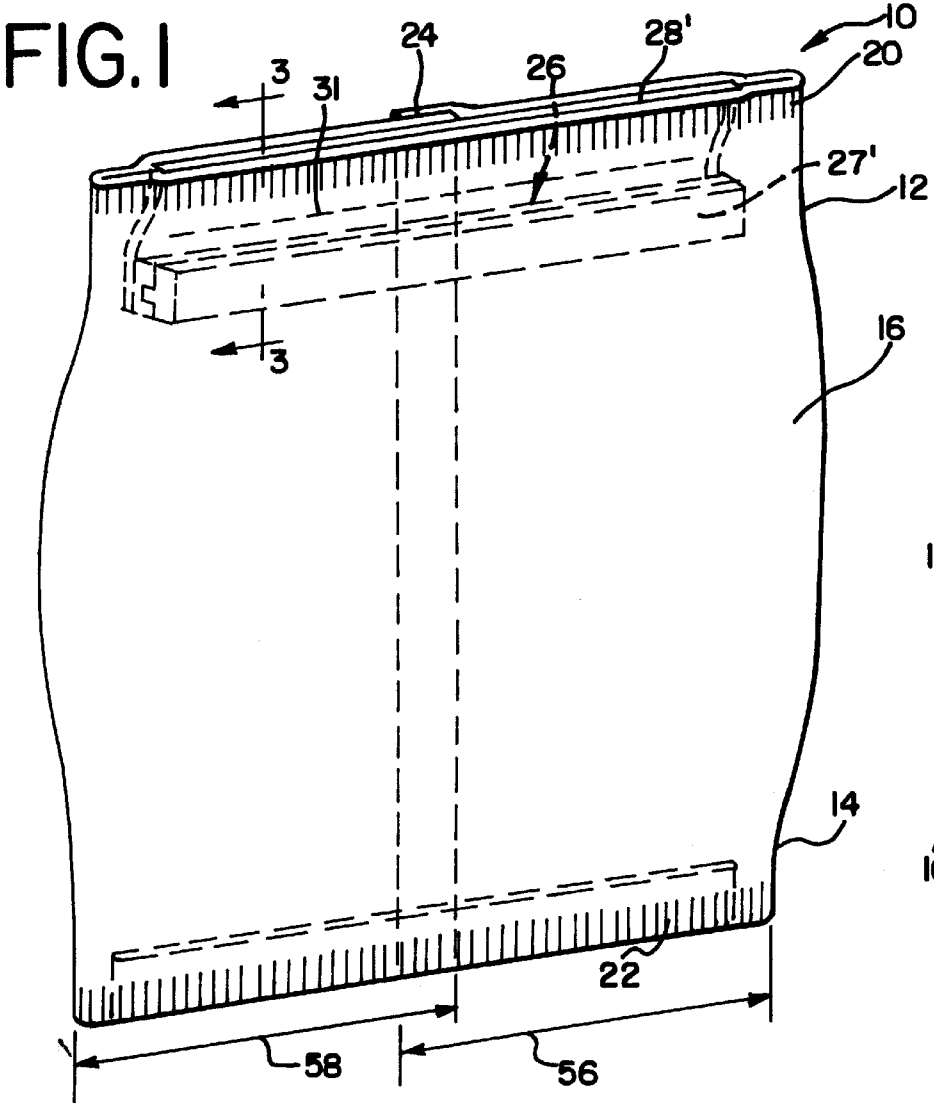
FIG. 1 is a perspective view of a package in the form of a recloseable bag embodying the principles of the present invention.
Figure 4:
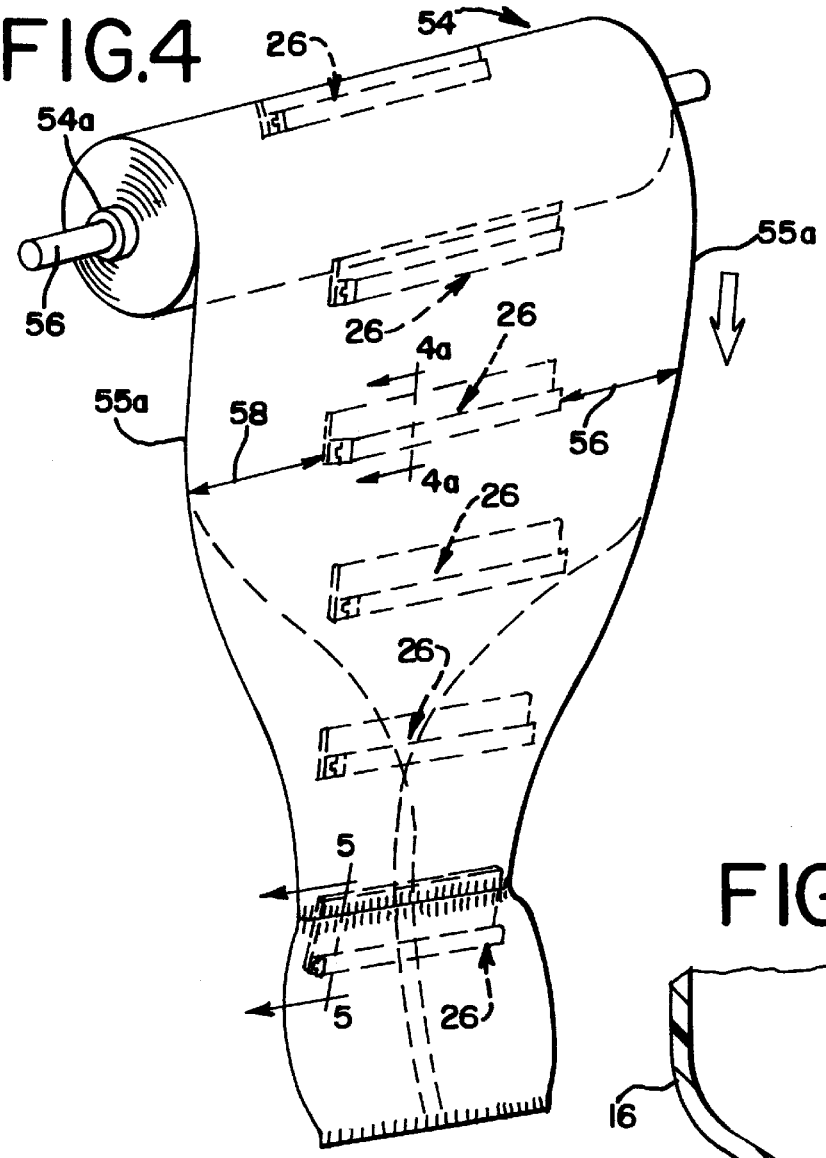
FIG. 4 is a diagrammatic view illustrating a method of making recloseable bags in accordance with the present invention.

With reference now to FIG. 4, therein is illustrated a method for forming recloseable bags embodying the principles of the present invention. A substantially continuous web of suitable film material, such as comprising plastic film, may be provided in the form of a roll 54 mounted on a suitable paper core 54*a* carried by a suitable support 56. A plurality of the fastener assemblies 26 are mounted on a surface of the film material transversely to the longitudinal axis thereof, with the preferred spacing of the fastener assemblies 26 from lateral edges 55*a* of the film material generally illustrated by double-sided arrows 56, 58. As will be noted by reference to FIGS. 1 and 4, the spacing of the fastener assemblies with respect to the lateral edges of the film material is such that after folding of the film material and sealing of the lateral edges thereof to each other to enclose the fastener assemblies, a tube is formed, with the resultant packages having the fastener assemblies appropriately centered on the front wall of the bag body. As will be further appreciated, the combined lengths of dimensions 56, 58, must be greater than the length of the recloseable fastener assembly 26 to enable the seal 24 to be formed for joining the lateral edges 55*a* of the film material.

Figure 5:
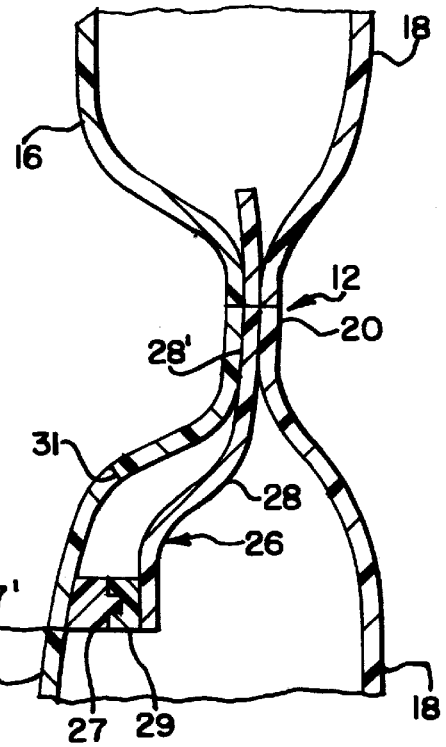
FIG. 5 is a fragmentary cross-sectional view taken along line 5—5 of FIG. 4.
Figure 4A:
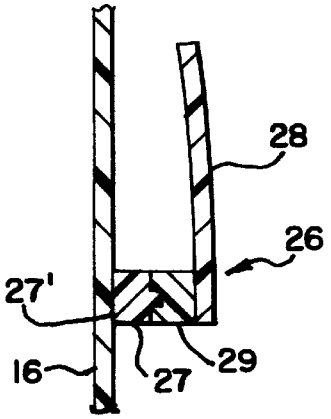
FIG. 4*a* is a fragmentary, cross-sectional view taken along lines 4*a*—4*a* of FIG. 4.

As will be observed by reference to FIG. 4*a*, each of the fastener assemblies 26 is joined to a surface of the film material by the respective seal 27', with the flange portion 28 of the profile strip 29 extending generally away from the profile strips for eventual sealing in one of the end seams of the bag. Such sealing is illustrated in FIG. 5, wherein the end seam of the bag is formed, thereby forming seal 28' joining the flange portion 28 of second profile strip 29 to the bag body. This end seal is formed attendant to filling of the bags with product during the form, fill, and seal packaging operation.

Figure 6:
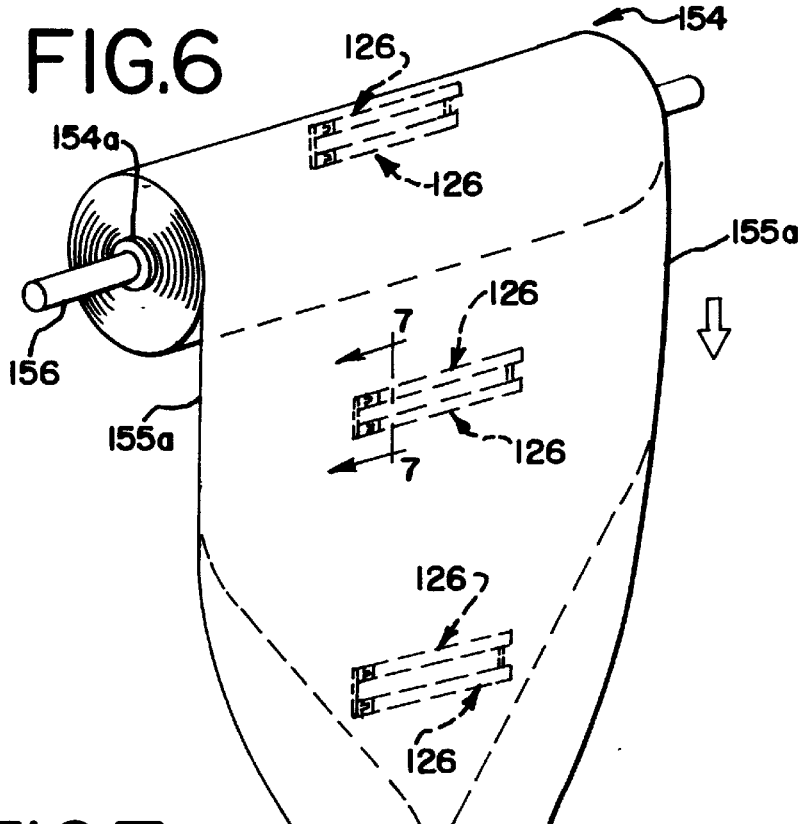
FIG. 6 is a diagrammatic view illustrating an alternate embodiment of the present method for making recloseable bags.
Figure 7:
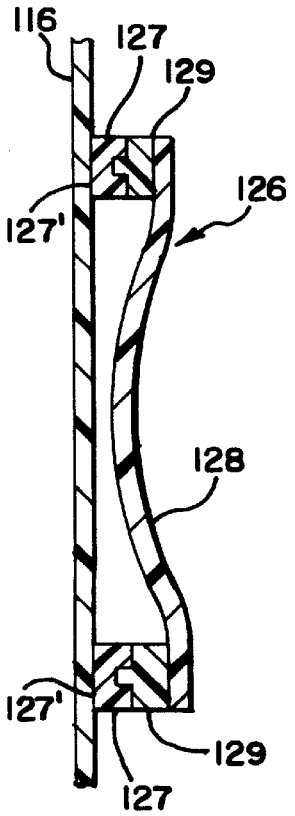
FIG. 7 is a fragmentary cross-sectional view taken along line 7—7 of FIG. 6.
Figure 7:
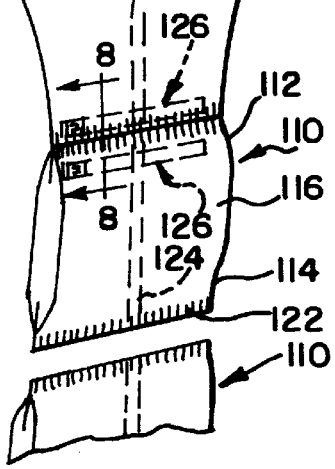
Figure 8:
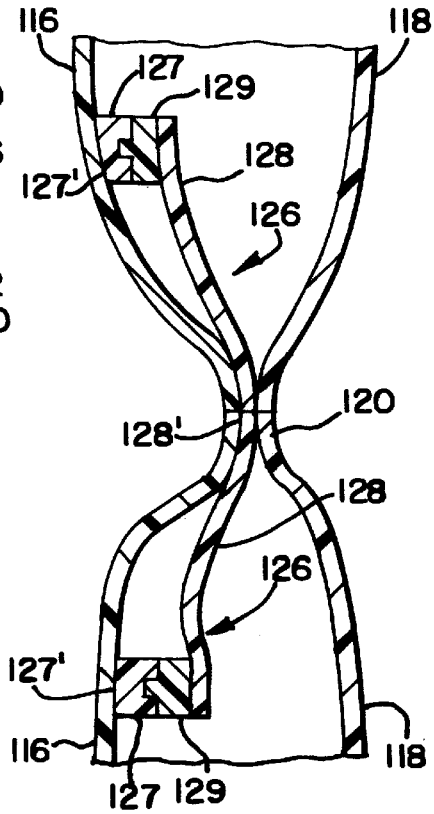
FIG. 8 is a fragmentary cross-sectional view taken along lines 8—8 of FIG. 6.

An alternate method for making bags in accordance with the present invention is illustrated in FIGS. 6–8. Reference numerals in the one-hundred series have been used to identify those components corresponding to like elements in the previously described embodiment.

In accordance with this embodiment, a method of making recloseable bags 110 includes providing a supply of film material, such as plastic film material, 154 supported on a core 154*a* and an associated support 156. A plurality of profile strip fastener assemblies, each designated 126, are connected to a surface of the film in spaced apart relationship to each other, and the film folded and lateral edges 155*a* thereof sealed to form a tube enclosing the fastener assemblies. In the previously-described embodiment, fastener assemblies 26 were placed on the associated film material 54 by a spacing corresponding to the length of the bags 110 being formed. The embodiment of the present invention illustrated in FIG. 6 differs in that the fastener assemblies 126 are placed on the film material in adjacent pairs, with a common flange portion 128 being provided which extends between the second profile strips 129 of the adjacent pair of fastener assemblies 126. Thus, as illustrated in FIGS. 7 and 8, this common flange portion 128 extends through the end seal 120 during filling of the bag, with a cut thereafter being formed at the end seal 120, whereby the common flange portion 128 is cut into a respective flange portion 128 for each of the respective fastener assemblies. As will be appreciated, in this illustrated embodiment, the end-to-end arrangement of the series of bags 110 being formed is such that the upper ends of adjacent pairs of the bags are joined together, if the opening for the bag is to be provided at the upper end. Alternatively, the lower ends of adjacent bags can be formed together with the fastener assemblies 126 of the adjacent bags sharing a common flange portion 128 extending through the common bottom seal of the bags.

From the foregoing, it will be observed that numerous modifications and variation can be effected without departing from the true spirit and scope of the novel concept of the present invention. It will be understood that no limitation with respect to the specific embodiments illustrated herein is intended or should be inferred. The disclosure is intended to cover, by the appended claims, all such modifications as fall within the scope of the claims.

What is claimed is:

1. A method of making recloseable bags, comprising the steps of:

providing a substantially continuous sheet of film material;

providing a plurality of fastener assemblies each comprising first and second interlocking profile strips each extending along the length of the respective fastener assembly, said profile strips being configured for releasable interlocking engagement with each other by the provision of at least one protuberance on one of the profile strips, and at least one groove defined by the other of the profile strips for respectively releaseably receiving said protuberance;

connecting each of said fastener assemblies to a surface of said film material in spaced apart relationship to each other transversely to and along a longitudinal axis of said film material by connection of a first one of said profile strips of each said fastener assembly to said surface of said film material;

folding said film material, and sealing lateral edges thereof to each other to form a tube enclosing said fastener assemblies; and sealing said tube of film material transversely to the longitudinal axis thereof to form a series of recloseable bags joined in end-to-end relationship, including providing a second one of said profile strips of each said fastener assembly with a flange portion, and sealing each said flange portion into said tube of film material during said transversely sealing of said tube of film material, each of said flange portions extending into an adjacent one of said series of recloseable bags joined in end-to-end relationship.

2. A method of making recloseable bag in accordance with claim 1, including sealing opposite ends of the profile strips of each said fastener assembly to each other and to said surface of said film material.

3. A method of making recloseable bags in accordance with claim 1, including forming frangible access means in said film material in alignment with each said fastener assembly.

4. A method of making recloseable bags in accordance with claim 1, wherein said flange portion of each said fastener assembly has a length less than the one-half distance between adjacent transversely sealed regions of said tube of film material.

5. A method of making recloseable bags, comprising the steps of:

providing a substantially continuous sheet of film material;

providing a plurality of fastener assemblies each comprising first and second interlocking profile strips each extending along the length of the respective fastener assembly, said profile strips being configured for releasable interlocking engagement with each other by the provision of at least one protuberance on one of the profile strips, and at least one groove defined by the other of the profile strips for respectively releaseably receiving said protuberance;

connecting each of said fastener assemblies to a surface of said film material in spaced apart relationship to each other transversely to and along a longitudinal axis of said film material by connection of a first one of said profile strips of each said fastener assembly to said surface of said film material;

folding said film material, and sealing lateral edges thereof to each other to form a tube enclosing said fastener assemblies; and sealing said tube of film material transversely to the longitudinal axis thereof to form a series of recloseable bags joined in end-to-end relationship, including providing a second one of said profile strips of each said fastener assembly with a flange portion, and sealing each said flange portion into said tube of film material during said transversely sealing of said tube of film material, said fastener assemblies being connected to said film material in adjacent pairs with a common one of said flange portions extending between the second ones of said profile strips of each adjacent pair for sealing transversely of said tube of film material between the fastener assemblies of each said adjacent pair of fastener assemblies.

6. A method of making a recloseable bag, comprising the steps of:

providing a substantially continuous sheet of film material;

providing a fastener assembly comprising first and second interlocking profile strips each extending along the length of the fastener assembly, said profile strips being configured for releasable interlocking engagement with each other by the provision of at least one protuberance on one of the profile strips, and at least one groove defined by the other of the profile strips for respectively releaseably receiving said protuberance;

connecting said fastener assembly to a surface of said film material transversely to a longitudinal axis of said film material by connection of a first one of said profile strips of each said fastener assembly to said surface of said film material;

folding said film material, and sealing lateral edges thereof to each other to form a tube enclosing said fastener assembly; and sealing said tube of film material transversely to the longitudinal axis thereof to form a recloseable bag, including providing a second one of said profile strips of said fastener assembly with a flange portion, and sealing each said flange portion into said tube of film material during said transversely sealing of said tube of film material.

7. A method of making a recloseable bag in accordance with claim 6, including forming frangible access means in said film material in alignment with said fastener assembly.

8. A method of making a recloseable bag in accordance with claim 6, including sealing opposite ends of the profile strips of said fastener assembly to each other and to said surface of said film material.

* * * * *